United States Patent [19]

Dye

[11] Patent Number: 5,007,411

[45] Date of Patent: Apr. 16, 1991

[54] DEVICE FOR APPLYING COMPRESSIVE PRESSURES AGAINST A PATIENT'S LIMB

[75] Inventor: John F. Dye, Bridgewater, Mass.

[73] Assignee: The Kendall Company, Mansfield, Mass.

[21] Appl. No.: 336,984

[22] Filed: Apr. 12, 1989

[51] Int. Cl.[5] ..... A61H 9/00

[52] U.S. Cl. ..... 128/64; 128/24 R

[58] Field of Search ..... 128/64, DIG. 20, 33, 128/24 R, 24.1, 24.2, 24.4, 24.3; 272/86; 137/542

[56] References Cited

U.S. PATENT DOCUMENTS

| | | | |
|---|---|---|---|
| 3,896,794 | 6/1975 | McGrath | 128/24 R |
| 4,030,488 | 6/1977 | Hasty | 128/24 R |
| 4,488,566 | 12/1984 | Hicks | 137/542 |
| 4,579,335 | 4/1986 | Centafanti | 272/69 |
| 4,793,328 | 12/1988 | Kolstedt et al. | 128/24 R |
| 4,841,956 | 6/1989 | Gardner et al. | 128/24 R |

*Primary Examiner*—Richard J. Apley
*Assistant Examiner*—Jerome W. Donnelly
*Attorney, Agent, or Firm*—Alvin Isaacs

[57] ABSTRACT

A device for applying compressive pressures against a patient's limb having a sleeve for applying pressure against a length of a patient's limb, with the sleeve having a plurality of chambers arranged longitudinally along the sleeve. The device intermittently inflates the chambers, and intermittently connects the chambers to an exhaust system during which a base static pressure is established in the chambers.

29 Claims, 3 Drawing Sheets

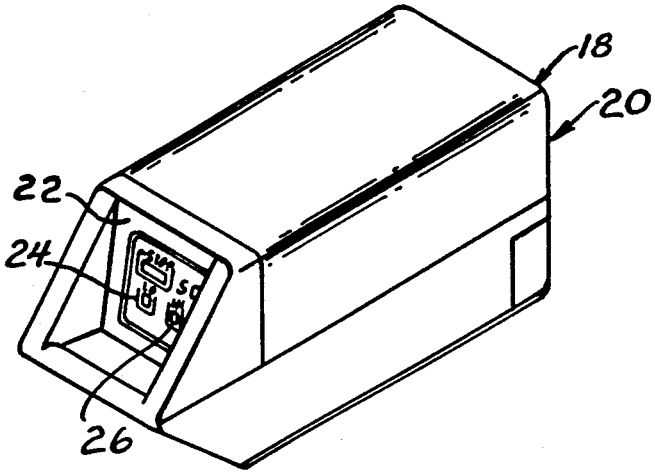
FIG. 1
FIG. 5
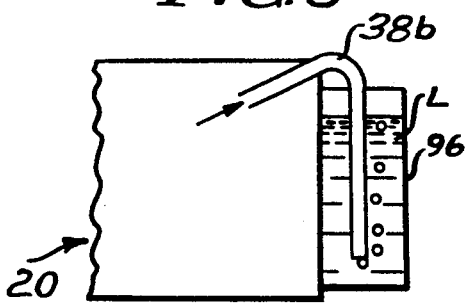
FIG. 2
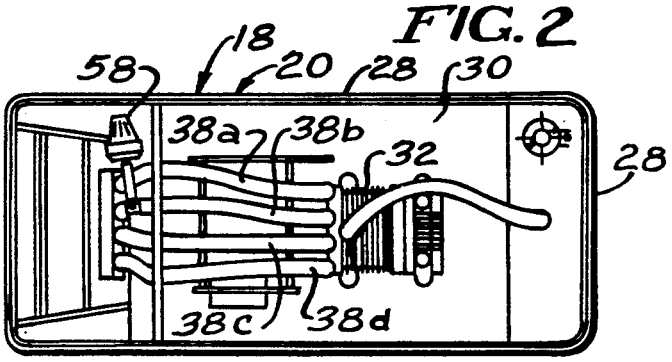
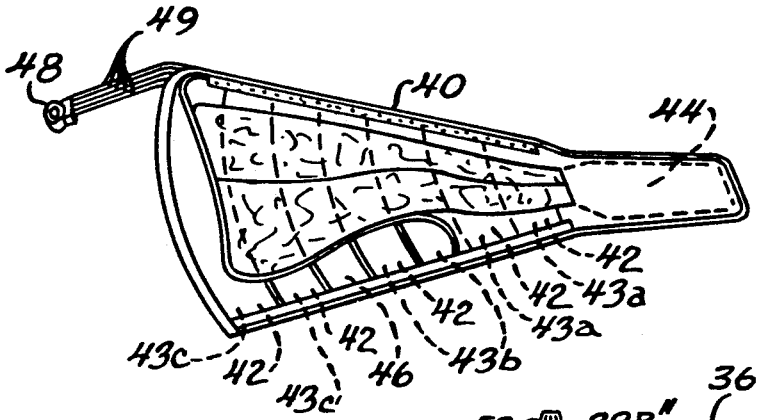
FIG. 3
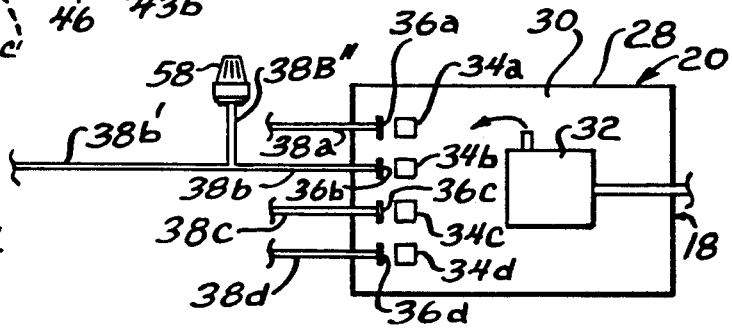
FIG. 4

DEVICE FOR APPLYING COMPRESSIVE PRESSURES AGAINST A PATIENT'S LIMB

BACKGROUND OF THE INVENTION

The present invention relates to devices for applying compressive pressures against a patient's limb.

Blood flow in a patient's extremities, particularly the legs, markedly decreases during extended periods of confinement. Such pooling or stasis is particularly acute in surgery and during recovery periods immediately thereafter.

Blood flow compressive devices, such as shown in U.S. Pat. Nos. 4,013,069 and 4,030,488, incorporated herein by reference, develop and facilitate the application of compressive pressures against the patient's limb and in so doing promoting venous return. The devices comprise a pair of sleeves which are wrapped around the patient's limbs, with a controller for supplying the pressurized fluid to the sleeve.

These sleeve devices may be seen in U.S. Pat. Nos. 4,402,312 and 4,320,746, which are also incorporated herein by reference.

One use for the above mentioned sleeves is the prevention of deep venous thrombosis (DVT) which sometimes occurs in surgical patients who are confined to bed. When a DVT occurs, the valves that are located within the veins of the leg can be damaged which in turn can cause stasis and high pressure in the veins of the lower leg. Patients who have this condition often have leg swelling (edema) and tissue breakdown (venous stasis ulcer) in the lower leg.

It has been shown that pneumatic compression can be highly effective in the treatment of such edema and venous ulcers. However, it is desirable to improve operation of the devices.

SUMMARY OF THE INVENTION

The present invention relates to an improved device for applying compressive pressures against a patient's limb.

The device of the present invention comprises a sleeve for applying pressure against a length of the patient's limb, with the sleeve having a plurality of chambers arranged longitudinally along the sleeve. The device has means for intermittently inflating the chambers during periodic compression cycles. The device has means for intermittently connecting the chambers to an exhaust means.

A feature of the present invention is the provision of means for establishing a residual pressure in the chambers.

Another feature of the invention is that the residual pressure in the chambers is established after some of the chambers of the sleeve is connected to the exhaust means.

Yet another feature of the invention is that inflating means inflates some of the chambers to form a compressive pressure gradient which decreases from a lower portion of the sleeve to an upper portion of the sleeve.

A feature of the present invention is that residual pressure established in the chambers reduces the requirement for air for inflation of the chambers during the periodic compression cycles.

Yet another feature of the invention is that in one embodiment additional chambers, such as used for placement against the foot and knee, are maintained at the residual pressure.

Still another feature of the invention is that the residual pressure in some of the chambers remains substantially the same throughout use of the device.

Yet another feature of the invention is that residual pressure remains in the chambers of the sleeves when they are connected to the exhaust means, such that some of the chambers may be more readily inflated during subsequent compression cycles.

Another feature of the invention is that the device controls endothelial stretch or venous distension.

Yet another feature of the invention is that by preinflating some of the chambers of the sleeve with the residual pressure, the sleeves are much less sensitive to fit.

Yet another feature of the invention is that the residual or base line pressure makes the sleeve conform more readily to the limbs.

Still another feature of the invention is that the demands required for a compressor used in the device to inflate the sleeves is reduced, such that the compressor may be made much smaller and less powerful.

Yet another feature of the invention is that in embodiments of the invention the sleeve may be designed to make it easier to apply since it is less sensitive to fit.

Yet another feature of the invention is that in one embodiment the device may be utilized to treat venous ulcers and edema in the home.

A further feature of the invention is that in another embodiment the device is utilized for the control of deep venous thrombosis for use in the hospital.

Further features will become more fully apparent in the following description of the embodiments of this invention and from the appended claims.

DESCRIPTION OF THE DRAWINGS

In the drawings:

FIG. 1 is a perspective view of a controller for a compressive pressure device of the present invention;

FIG. 2 is a plan view of an internal portion of the controller of FIG. 1;

FIG. 3 is a perspective view of a sleeve for use with the device of FIG. 1;

FIG. 4 is a diagrammatic view of the controller of FIG. 1;

FIG. 5 is a fragmentary elevational view of another embodiment of the device of the present invention;

DESCRIPTION OF THE PREFERRED EMBODIMENTS

Figure 6:
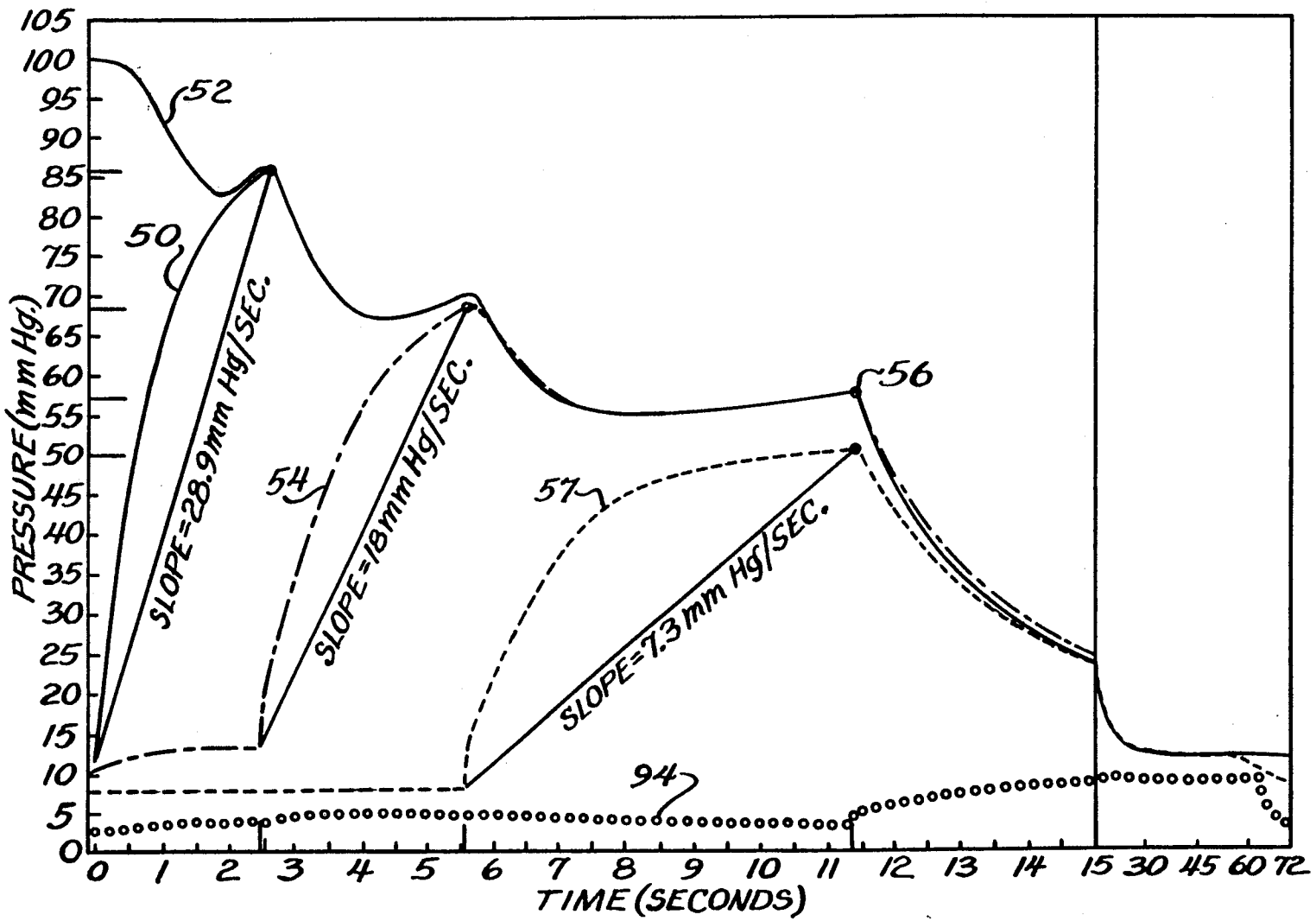
FIG. 6 is a graph illustrating pressure profiles as plotted versus time formed by the device of the present invention.

Referring now to FIG. 1, there is shown a controller 20 for a compressive pressure device generally designated 18 of the invention, with the controller 20 having a display panel 22. The display panel 22 has a first lo switch 24 and a second hi switch 26 for controlling two different levels of compression for a sleeve during use of the device.

Referring now to FIGS. 2–4, the controller 20 has a plurality of closed walls 28 defining an accumulator or cavity 30 with a fixed volume for compression of fluid. The controller or device 20 has a compressor 32 which discharges gas into the accumulator 30, and builds up pressure in the accumulator 30 over a period of time, such as for ten seconds to a pressure of 80 to 100 mmHg.

The controller 20 of the device 18 has a plurality of valves 34*a*, 34*b*, 34*c*, and 34*d* in the accumulator 30 associated with ports 36*a*, 36*b*, 36*c*, and 36*d* of respective conduits 38*a*, 38*b*, 38*c*, and 38*d*, with the valves 34*a*, 34*b*, 34*c*, and 34*d* being utilized to open and close the ports 36*a*, 36*b*, 36*c*, and 36*d* of the conduits 38*a*, 38*b*, 38*c*, and 38*d* as desired. The device 18 has a compression sleeve 40 having a plurality of inflatable chambers 42 disposed longitudinally along the sleeve 40, including a separate chamber 44 for placement against the foot, and a separate chamber 46 for placement against the knee. The sleeve 40 has a connector 48 for connection of conduits 49 communicating with the chambers 42 of the sleeve 40 with the conduits 38*a*, 38*b*, 38*c*, and 38*d*. The conduit 38*a* is connected to an ankle chamber 43*a* of the sleeve 40, the conduit 38*b* is connected to the foot and knee chambers 44 and 46 of the sleeve 40, the conduit 38*c* is connected to a calf chamber 43*b* of the sleeve 40, the conduit 38*d* is connected to a thigh chamber 43*c* of the sleeve 40.

The valves 34*a*, 34*b*, 34*c*, and 34*d* are closed in order to prevent passage of fluid through the ports 36*a*, 36*b*, 36*c*, and 36*d* while the compressor 32 charges the accumulator 30 with the pressurized gas. Next, the valve 34*a* is opened to permit passage of pressurized fluid from the accumulator 30 through the port 36*a* and conduit 38*a* into the ankle chamber in order to inflate the ankle chamber and apply a compressive pressure by the ankle chamber against the patient's limb, with the pressure curve or profile 50 of the ankle chamber being illustrated in FIG. 6 where pressure in mmHg is plotted against time in seconds. As shown, the ankle chamber is inflated while the pressure curve or profile of the accumulator 52 decreases as a function of time to a value approximately the maximum ankle pressure. After a sufficient time of inflation and increase of pressure in the ankle chamber, the valve 34*c* is opened to permit passage of the pressurized fluid through the port 36*c* and conduit 38*c* to a calf chamber in the sleeve 40, resulting in inflation of the calf chamber with the pressure curve or profile 54 of the calf chamber being illustrated in FIG. 6. After sufficient inflation of the calf chamber, the valve 34*d* is opened to permit passage of pressurized fluid through the port 36*d* and conduit 38*d* to a thigh chamber of the sleeve 40, and the thigh chamber is inflated in order to increase pressure in the thigh chamber, as illustrated by the curve 57 in FIG. 6. In this manner, the ankle, calf and thigh chambers are sequentially inflated at spaced intervals of time during intermittent compression cycles.

After inflation of the thigh chamber, at a specified time determining a set pressure 56, the valve 34*b* is opened in order to open the port 36*b* and establish communication by the accumulator 30 with the conduit 38*b*. In turn, the conduit 38*b* establishes fluid communication with the foot chamber 44 and knee chamber 46 through a downstream portion 38*b*′ of the conduit 38*b*. Also, the conduit 38*b* establishes communication with a relief valve 58 through a conduit portion 38*b*″ which communicates with the conduit 38*b*. At this time, the valves 34*a*, 34*c*, and 34*d* are opened to permit passage of the fluid from the ankle, calf and thigh chambers into the accumulator 30, and passage through the port 36*b* associated with valve 34*b* into the conduit 38*b*. At this time, a majority of the pressurized fluid passes to the relief valve 58 which serves as an exhaust for the device 18, as will be further described below, while the remainder of the fluid passes through the downstream conduit portion 38*b*′ to a lesser extent due to the substantial length of the downstream conduit portion 38*b*′. As will be further described below, the relief valve 58 allows a drop of pressure in the accumulator 30 to a substantially lower predetermined pressure, such as 10 mmHg, in addition to establishing such a pressure in the foot chamber 44 and knee chamber 46. At this time, the valves 34*a*, 34*b*, 34*c*, and 34*d* are closed, and the compressor 32 continues to remain in operation, such that the pressure in the accumulator 30 again begins to substantially rise due to the compressor 32.

Figure 8:
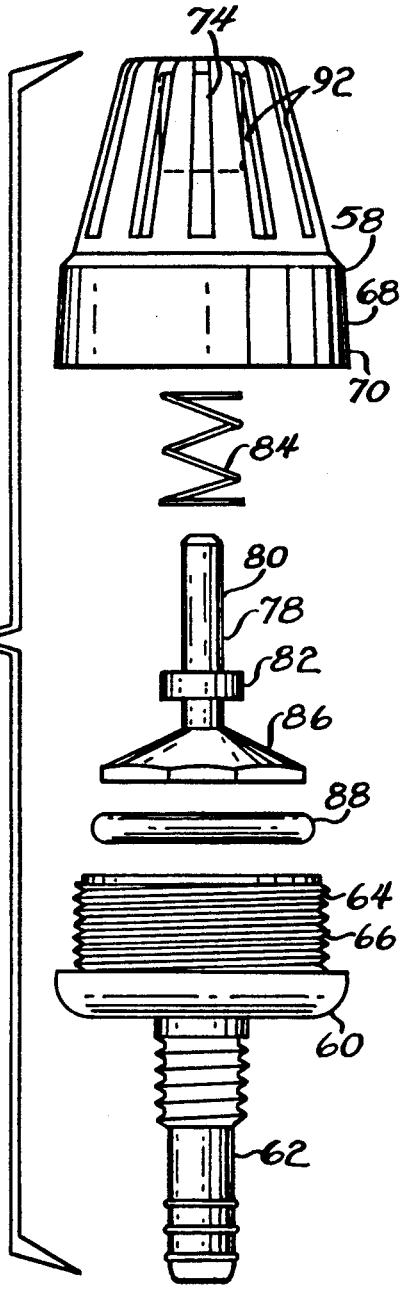
FIG. 8 is an exploded view of a relief valve for the device of FIG. 2.
Figure 9:
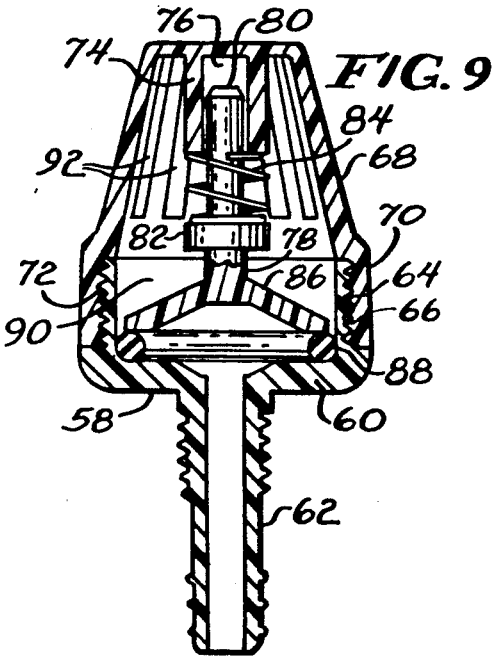
FIG. 9 is a sectional view of the device of FIG. 8.

As shown in FIGS. 8 and 9, the relief valve 58 has a first body portion 60 having a hollow stem 62 at one end for connection to the conduit portion 38*b*″. The first body portion 60 has an outer annular flange 64 with outer threads 66. The relief valve 58 has a second body portion 68 having an inner annular flange 70 having inner threads 72 which cooperate with the threads 66 of the flange 64 in order to releasably secure the second body portion 68 at an adjustable position on the first body portion 60. An outer end of the second body portion 68 has an inwardly directed cylindrical portion 74 having a recess 76 for purposes which will be described below, and a plurality of elongated slots 92 extending therethrough. The relief valve 58 has a valve member or plunger 78 having an elongated stem 80 which is received in the recess 76 of the cylindrical portion 74. The valve member 78 has an annular collar 82 on the stem 80, and a helical spring 84 which extends between the cylindrical portion 74 and the collar 82. The valve member 78 has an inner outwardly diverging annular valve portion 86, which faces an elastic O-ring 88 located at an inner portion of a cavity 90 defined by the flange 64. The spring 84 biases the valve member 78 toward the first body portion 60 of the relief valve 58, and biases the valve portion 86 toward the O-ring 88 which serves as a seat. The amount of force exerted by the valve portion 86 against the O-ring 88 may be adjusted through suitable adjustment of the first body portion 60 relative to the second body portion 68 through use of the cooperating threads 66 and 72.

In use, the fluid under pressure passes through the stem 62, between the O-ring 88 and the valve portion 86, and through the slots 92 in order to permit exhaust of the fluid under pressure from the accumulator 30.

In use, the pressurized fluid passing through the relief valve 58 moves the valve portion 86 away from the O-ring 88 such that equilibrium is reached between the plunger spring 84 and pressure in order to permit passage of fluid from the exhaust through the slots 92, after which the valve member 78 closes against the O-ring 88. The pressurized fluid will continue to bleed through the relief valve until the valve 34*b* closes to cause fluid pressure to again build in the accumulator 30.

In this manner, the chambers 42 of the sleeve 40 are sequentially inflated to form a compressive pressure in the chambers which decreases at intervals of time when attained from a lower portion of the sleeve to an upper portion of the sleeve and during exhaust of the chambers 42 in the sleeve 40 through the relief valve 58 at least once, a residual or base static pressure, such as 10 mmHg, remains in the ankle, calf, and thigh chambers, as well as being introduced into the foot and knee chambers 34 and 36. The residual or base static pressure remains during non-inflation of the ankle, calf, and thigh chambers during periodic decompression cycles, and the residual pressure curve or profile 94 is illustrated as a function of time in the graph of FIG. 6 for the foot chamber 44 and knee chamber 46, and remains substantially the same throughout operation of the device 18. Thus, the residual pressure remains in the ankle, calf, and thigh chambers, and this pressure makes the sleeve 40 less sensitive to fit on a patient's limb in order that the sleeve 40 could be loosened to a greater extent. Also, the demands imposed on the compressor 32 to inflate the sleeves 40 are substantially lessened, such that a much smaller and less powerful compressor 32 may be utilized in the device 18 which substantially reduces its cost. The described embodiment in connection with FIGS. 1–4 may be utilized by the patient at home. In summary, the device 18 passes through a few compression cycles to inflate the chambers 42 before the base line or residual pressure is established in the chambers 42. Thus, once the residual pressure is established in the ankle, calf, and thigh chambers, the requirements for fluid under pressure in order to increase the pressure of the chambers 42 to the desired pressure profiles is substantially decreased, thus decreasing the demands upon the nature of the compressor 32.

Another embodiment of the present invention is illustrated in FIG. 5. In this embodiment, the conduit **38*b* extends to a lower portion of a container 96 containing a supply of liquid L, such as water. The gas under pressure passes through the conduit 38*b*, and bubbles through the liquid L in order to establish the residual pressure in the sleeve chambers during the non-inflation or decompression periods of the device. In this manner, the residual pressure of the sleeve 40 is controlled through use of the passage of gas through the liquid L. The container 96 may be attached to a side of the controller 20** for convenience, if desired.

Figure 7:
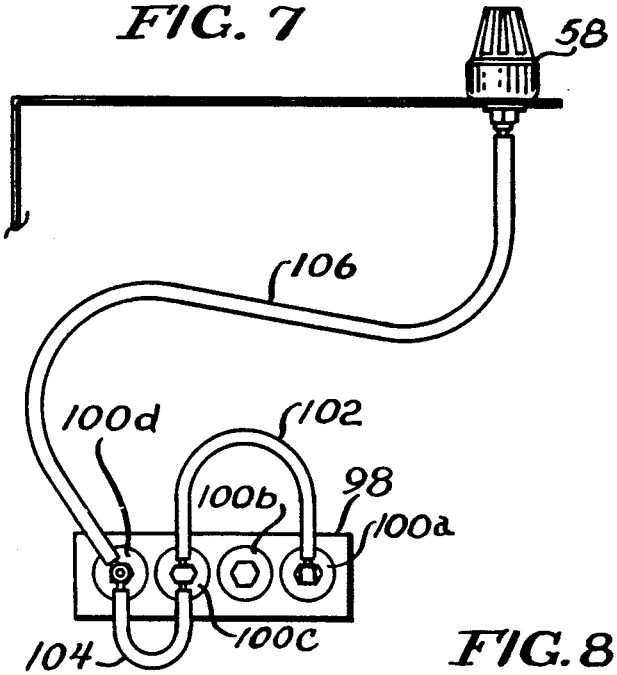
FIG. 7 is a plan view of an exhaust system for another embodiment of the device of the present invention.

Another embodiment of a device 98 for the exhaust of chambers from a sleeve is illustrated in FIG. 7, in which like reference numerals designate like parts. In this embodiment, the device 98 has a plurality of solenoid valves **100*a*, 100*b*, 100*c*, and 100*d*. The valve 100*a* is connected by a conduit 102 to the valve 100*c*, and the valve 100*c* is connected by a conduit 104 to the valve 100*d*. In turn, the valve 100*d* is connected by a conduit 106 to a pressure relief valve 58 of the type previously described in connection with FIGS. 8 and 9 which operates in the same manner. In this embodiment, the valves 100*a*, 100*c*, and 100*d*, which are respectively connected to the ankle, calf, and thigh chambers of the sleeve, are simultaneously opened in order to permit passage of the fluid from the ankle, calf, and thigh chambers through the conduits 102, 104, and 106 to the relief valve 58 which serves as an exhaust for the fluid under pressure. The valve 58 closes at a predetermined pressure, e.g., 5–10 mmHg, as previously described, in order to establish the base line or residual pressure in the chambers such that the requirements for subsequent inflation of the chambers and demands for the compressor are minimized. The device 98 of FIG. 7** is designed primarily for use in the hospital for the treatment of deep *venous thrombosis*, and the sleeve for this device may not have a foot or knee chamber. The valve **100*b* is used in connection with a ventilation chamber in the sleeve which passes air onto the patient's limb such that the gas is continuously expelled to the atmosphere, and need not be connected to the relief valve 58**.

Figure 10:
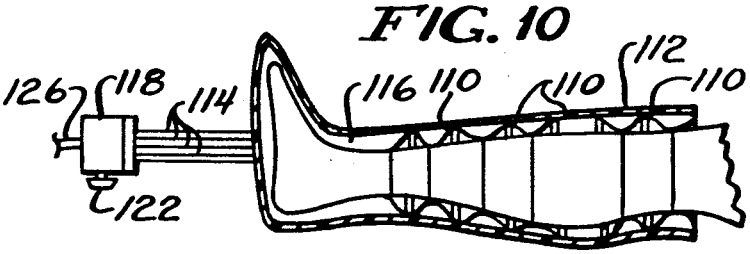
FIG. 10 is a sectional view of a sleeve in another embodiment of the present invention.

Another embodiment of the present invention is illustrated in FIG. 10, in which like reference numerals designate like parts. In this embodiment, there is shown a sleeve 108 having a plurality of inflatable chambers 110 disposed longitudinally along the sleeve 108. The device of FIG. 10 has an outer fluid impervious wall 112 which closes the chambers 110 of the sleeve 108 in sealing engagement to form a chamber 116 between the wall 112 and chambers 110. The device has a plurality of conduits 114 which are connected to the chambers 110 of the sleeve 108 and to the chamber 116 between the wall 112 and the chambers 110. The chambers 110 of the sleeve 108 are inflated in a suitable manner through the conduits 114, as previously described, while the chamber 116 closed by the wall 112 is also inflated over the chambers 110 in order to establish a residual or base line pressure outside of the chambers 110.

In a preferred form, the device of FIG. 10 has an adapter 118 which is connected between a conduit 120, such as the conduit **38*b* connected to the solenoid valve 34*b* of FIG. 4, with the adapter 118 containing a pressure regulator which may be modified by a suitable adjustment device 122 such that a desired pressure may be maintained accurately in the chamber 116. In an alternative form, the conduit 38*b* from the controller 20 may be connected directly to the chamber 116 of the device of FIG. 10** in order to establish the residual pressure.

The foregoing detailed description is given for clearness of understanding only, and no unnecessary limitations should be understood therefrom, as modifications will be obvious to those skilled in the art.

What is claimed is:

1. A device for applying compressive pressures against a patient's limb during periodic compression cycles comprising:

a sleeve for applying pressure against a length of a patient's limb, said sleeve having a plurality of chambers arranged longitudinally along the sleeve;

means for intermittently inflating each of said chambers to provide a predetermined pressure during periodic compression cycles; and means for deflating said chambers to establish a base static pressure after each said compression cycle.

2. The device of claim 1 wherein the inflating means sequentially inflates the chambers to maximum pressures which decrease at intervals of times when attained from a lower portion of the sleeve to an upper portion of the sleeve.

3. The device of claim 1 wherein the sleeve includes a chamber for applying pressure against the foot, and in which the establishing means forms a base pressure in the foot chamber.

4. The sleeve of claim 1 wherein the sleeve includes a chamber for applying pressure against the knee, and in which the establishing means forms a base pressure in the knee chamber.

5. The device of claim 1 wherein the inflating means sequentially inflates said chambers.

6. The device of claim 1 wherein the inflating means includes means for establishing a source of pressurized fluid, and means for sequentially connecting the source to said chambers.

7. The device of claim 1 wherein the means for deflating said chambers comprises means for intermittently connecting the chambers to an exhaust means.

8. The device of claim 7 wherein the connecting means simultaneously connects all the chambers to the exhaust means.

9. The device of claim 7 wherein the connecting means includes a plurality of valves to control the passage of fluid from the chambers to the exhaust means.

10. The device of claim 7 wherein the connecting means includes valve means for establishing said basic static pressure.

11. The device of claim 10 wherein the valve means includes means for adjusting the value of the base static pressure.

12. The device of claim 11 wherein the valve means comprises a valve member, a seat, and means for biasing the valve member against the seat.

13. The device of claim 10 wherein the biasing means is adjustable.

14. The device of claim 10 wherein the valve means comprises a first body portion having an annular wall defining a cavity, a second body portion having an annular wall and opening means, means for releasably securing said annular walls of the first and second body portions together, a valve seat in the cavity of the first body portion, a valve member extending from an outer portion of the second body portion, and means for biasing the valve member against the seat.

15. A device for applying compressive pressures against a patient's limb, comprising:

a sleeve for applying pressure against a length of a patient's limb, said sleeve having a plurality of chambers arranged longitudinally along the sleeve;

means for establishing a static base pressure in said chambers; and means for intermittently inflating said chambers to a pressure greater than said static base pressure and forming a compressive pressure in the chambers which decreases at intervals of time when attained from a lower portion of the sleeve to an upper portion of the sleeve.

16. A device for applying compressive pressures against a patient's limb, comprising:

a sleeve for enclosing a length of a patient's limb, said sleeve having a plurality of chambers arranged longitudinally along the sleeve;

means for intermittently inflating said chambers during periodic compression cycles; and means for intermittently connecting the chambers to an exhaust means during periodic decompression cycles; and means for establishing a static base pressure in the chambers during the decompression cycles.

17. The device of claim 16 wherein the establishing means comprises valve means.

18. The device of claim 16 wherein the establishing means comprises a container retaining a quantity of liquid, and conduit means of the connecting means extending into the liquid.

19. A device for applying compressive pressures against a patient's limb, comprising:

accumulator means defining a cavity for retaining a volume of fluid;

means for forming a source of pressurized fluid in said accumulator means;

a sleeve having a plurality of chambers arranged longitudinally along the sleeve;

valve means for sequentially connecting the cavity to said chambers while forming a compressive pressure gradient which decreases from a lower portion of the sleeve to an upper portion of the sleeve;

pressure relief means to permit passage of fluid at a predetermined base pressure; and means for selectively connecting the cavity to the pressure relief means to form the predetermined pressure in the accumulator means.

20. The device of claim 19 wherein the valve means permits passage of fluid from the chambers to the cavity while the connecting means permits passage of fluid from the cavity to the pressure relief means.

21. The device of claim 19 wherein the connecting means includes valve means for connecting the cavity to the pressure relief means.

22. The device of claim 19 wherein the forming means comprises a compressor.

23. The device of claim 19 including means for adjusting the predetermined pressure of the pressure relief means.

24. The device of claim 19 wherein the pressure relief means comprises valve means to permit passage of fluid therethrough.

25. The device of claim 19 wherein the pressure relief means comprises a container retaining a quantity of liquid, and conduit means in fluid communication with the accumulator means and extending below an upper level of the liquid.

26. A device for applying compressive pressures against a patient's limb, comprising:

a sleeve for applying pressure against a length of a patient's limb, said sleeve having a plurality of chambers arranged longitudinally along the sleeve;

means for intermittently inflating said chambers during periodic compression cycles; and valve means for simultaneously connecting the chambers to an exhaust means and for establishing a static base pressure in the chambers.

27. The device of claim 26 wherein the establishing means comprises a pressure relief valve, and including conduit means connecting the valve means to the exhaust means.

28. A device for applying compressive pressures against a patient's limb, comprising:

a sleeve for applying pressure against a length of a patient's limb, said sleeve having a plurality of compression chambers arranged longitudinally along the sleeve;

means for intermittently inflating said chambers during periodic compression cycles;

chamber means defining a chamber enclosing the compression chambers; and means for forming a residual pressure in the chamber of said chamber means.

29. The device of claim 28 wherein the chamber means comprises elongated wall means enclosing said compression

* * * * *